United States Patent [19]

Benefice-Malouet et al.

[11] Patent Number: 5,023,370

[45] Date of Patent: Jun. 11, 1991

[54] FUNCTIONALIZATION OF IODOPOLYFLUOROALKANES BY ELECTROCHEMICAL REDUCTION AND NEW FLUORINATED COMPOUNDS THEREBY OBTAINED

[75] Inventors: Sylvie Benefice-Malouet, Montpellier; Hubert Blancou, Magalas, both of France

[73] Assignee: Atochem, Courbevoie, France

[21] Appl. No.: 322,271

[22] Filed: Mar. 10, 1989

Related U.S. Application Data

[62] Division of Ser. No. 38,188, Apr. 14, 1987, Pat. No. 4,830,715.

[30] Foreign Application Priority Data

Apr. 17, 1986 [FR] France ..... 86 05519

[51] Int. Cl.[5] ..... C07C 303/00

[52] U.S. Cl. ..... 562/125; 260/400

[58] Field of Search ..... 260/513 F, 400; 562/125

[56] References Cited

U.S. PATENT DOCUMENTS

| | | | |
|---|---|---|---|
| 2,519,983 | 8/1950 | Simons | 204/59 R |
| 2,606,206 | 8/1952 | Guenthner | 204/81 |
| 3,283,012 | 11/1966 | Day | 204/157.9 |
| 3,810,939 | 5/1974 | Chaudhuri | 260/513 F |
| 4,098,806 | 7/1978 | Commeyras et al. | 260/405.5 |
| 4,221,734 | 9/1980 | Commeyras | 260/513 F |
| 4,282,162 | 8/1981 | Kuhls | 260/513 F |
| 4,332,954 | 6/1982 | Koshar | 260/513 F |
| 4,394,225 | 7/1983 | Commeyras et al. | 204/59 R |
| 4,452,852 | 6/1984 | Blancou et al. | 568/843 |
| 4,466,881 | 8/1984 | Hamada et al. | 204/59 F |
| 4,466,926 | 8/1984 | Millauer | 204/59 F |
| 4,647,350 | 3/1987 | Hallcher et al. | 204/59 F |

FOREIGN PATENT DOCUMENTS

| | | |
|---|---|---|
| 2342950 | 9/1977 | France . |
| 2521987 | 8/1983 | France . |
| 47-37520 | 9/1972 | Japan . |

OTHER PUBLICATIONS

Brace, N. "Some Approaches to the Synthesis of Fluorinated Alcohols and Esters, II. Use of F-Alkyl Iodides for the Synthesis of F-Alkyl Alkonols", *J. Fluor. Chem.* 20, pp. 313-327 (1982).

Calas et al., "Change in the Mechanism of the Electroreduction of the Perfluoro-n-Hexyl Iodide With Varying the Nature of the Supporting Salt", *J. Electroanal. Chem.* 89, pp. 363-372 (1978).

Calas et al., "Chemical Reaction Between the Perfluoro-n-Hexyl Iodide and Polarized Mercury, Yielding the Perfluoro-n-Hexyl Mercuric Iodide", *J. Electroanal. Chem.* 89, pp. 373-378 (1978).

*Chem. Abstracts* 96:142214d, Huang et al., Huaxue Xueboe 39(5) pp. 481-483 (1981).

Germain et al., Tetrahedron 37, 487-491 (1981).

Krunyants et al., "Synthesis of Fluoroorganic Compounds", preface.

*Primary Examiner*—Alan Siegel

*Attorney, Agent, or Firm*—Pennie & Edmonds

[57] ABSTRACT

The invention relates to the preparation of functionalized derivatives from iodopolyfluoroalkanes by electrochemical reduction. This reduction is carried out in a formamide or substituted formamide solvent which may contain up to 70% (by volume) water, on a carbon cathode; for certain embodiments sulfur dioxide may also be present. This method of preparing perfluoroalkanecarboxylic acids $R_FCOOH$ or perfluoroalkanesulphinic acids, $R_FSO_2H$ and alcohols of the $R_FC_2H_4OH$ type, also makes it possible to prepare new fluorinated compounds of formulae: $I—(CH_2)_{p-1}—COOH$ and $HO_2S—(CF_2)_{p-1}—COOH$, in which p is an even-numbered integer which may range from 4 to 12.

2 Claims, No Drawings

FUNCTIONALIZATION OF IODOPOLYFLUOROALKANES BY ELECTROCHEMICAL REDUCTION AND NEW FLUORINATED COMPOUNDS THEREBY OBTAINED

This is a division of application Ser. No. 07/038,188 filed Apr. 14, 1987, now U.S. Pat. No. 4,830,715.

TECHNICAL FIELD

The present invention relates to the functionalization of iodopolyfluoroalkanes and, more particularly, to the preparation of compounds containing a perfluorinated chain and at least one acid or alcohol group by the electrochemical reduction of iodopolyfluoroalkanes.

BACKGROUND OF INVENTION

Polyfluorinated alcohols of the type $R_FCH_2CH_2OH$, wherein $R_F$ denotes a perfluoroalkyl radical, are precursors of treatment agents for surfaces and materials. These compounds can be prepared starting with 1-iodo-2-perfluoroalkyl-ethanes, $R_FC_2H_4I$ following different methods; for example, reacting with an aqueous solution of an amide (publication JP 72-37,520) reacting with fuming sulfuric acid (U.S. Pat. No. 3,283,012), or forming, in tributyl phosphate, an organozinc intermediate which is subsequently, oxidized, and then hydrolyzed (French Patent 2,521,987). However, the synthesis of these alcohols by the electrochemical reduction of $R_FC_2H_4I$ compounds has not yet been accomplished.

The preparation of perfluoroalkanecarboxylic acids $R_FCOOH$ or perfluoroalkanesulphonic acids $R_FSO_3H$ has formed the subject of many investigations, because of the utility of these acids as precursors of surface active agents. Their synthesis was first carried out starting with the acid chlorides of alkanecarboxylic acids and alkanesulphonic acids respectively, by electrofluorination in anhydrous hydrofluoric acid (U.S. Pat. No. 2,519,983). However, this technique which is well-suited to the preparation of acids of low molar weights, gives very low yields in the preparation of acids of high molecular weights. In order to overcome this drawback, Calas et al. (J. Electroanal. Chem., 1978, 89, 363–372) have proposed the electrochemical reduction of perfluoroalkyl iodides $R_FI$ on a polarized mercury bed in the presence of $SO_2$ or $CO_2$, which makes it possible to prepare perfluoroalkanesulfonic or perfluoroalkanecarboxylic acids with 70% and 90% yields respectively. Unfortunately, the use of mercury makes the application of this method on an industrial scale prohibitory.

SUMMARY OF INVENTION

It is an objective of this invention to describe a process for the functionalization of iodopolyfluoroalkanes by electrochemical reduction. This process is further characterized in that the reduction is carried out in a solvent of the formamide type on a carbon cathode, and, optionally, in the presence of water and/or sulfur dioxide.

By proper selection of the starting iodopolyfluoroalkanes and reaction conditions, a wide array of functionalized derivatives can be prepared including carboxylic acids, sulfinic acids and diacids. Two new classes of fluorinated compounds of the formulae:

$$I-(CF_2)_{p-1}-COOH \text{ and}$$

$$HO_2S-(CF_2)_{p-1}-COOH$$

where p is an even-numbered integer which can range from 4–12, can be produced by these methods.

DETAILED DESCRIPTION OF THE PREFERRED EMBODIMENTS

A large number of iodopolyfluoroalkanes can be used as starting materials including, but not limited to: perfluoroalkyl iodides $R_FI$, of the general formula:

$$C_nF_{2n+1}-I \quad (1)$$

in which n is an integer ranging from 2 to 16, and the perfluorinated chain can be straight or branched; $\alpha,\omega$-diiodoperfluoralkanes of the general formula:

$$I-(CF_2)_p-I \quad (2)$$

where p is an even-numbered integer ranging from 4 to 12; and iodo-2-perfluoroalkylethanes of formula:

$$C_nF_{2n+1}-CH_2CH_2-I \quad (3)$$

in which n has the same meaning as above.

The solvent in which the electrochemical reduction according to the invention is carried out is a formamide compound. This compound can be formamide itself or an N-substituted derivative of the latter, such as methylformamide, or preferably dimethylformamide. This solvent may be in its pure form (that is, containing less than 0.2 vol. % of water) or as an aqueous mixture, so long as $SO_2$ is simultaneously used and the proportion of water does not exceed 70% by volume and preferably remains less than 30% by volume. Additionally, as will be explained later, the water content of the solvent has a significant effect on the functionalized fluorinated derivatives formed in accordance with the process according to the invention.

The carbon cathode used according to the invention may consist of woven or nonwoven carbon fibres, or a vitreous carbon plate. When a carbon fiber cathode is employed, it is sometimes desirable (especially in the case of $R_FI$) to operate in the presence of an activator chosen from allyl alcohol, propargyl alcohol, 2-iodo-3-perfluoroalkylpropanols (French Patents 2,486,521 and 2,486,522) and 1,1-dichloro-2-perfluoroalkyl-ethylenes (French Patent 2,559,479). The activator concentration may range up to 10% by volume relative to the solvent mixture, but is preferably between 0.02 and 0.2%. The preferred activator is allyl alcohol.

The anode is preferably identical in composition to the cathode, but it may also consist of any customary material for electrodes including, but not limited to, nickel, platinum, gold and lead.

Provided that it has a reduction potential more negative than that of iodopolyfluoroalkane, the support electrolyte, whose role is to ensure the passage of current, may be chosen from all inorganic or organic salts known for this purpose (see, for example, "Organic E)ectro-chemistry" by M. M. BAIZER, 1973, p 227–230). More particularly, halides perchlorates, and arylsulphonates of alkali metals (preferably lithium), or tetraalkylammonium containing $C_1$ to $C_4$ alkyl radicals are preferred. The concentration range of support electrolyte may range from 0.01 to 1 mole per liter of the solvent mixture.

The electrochemical reduction can be carried out at constant current intensity or at constant voltage, in various types of common cells. Although it is possible to operate in a single-compartment cell, it is preferred to carry out the operation in a cell with two compartments in order to avoid unrestricted free movement of the compounds between the cathode and the anode; in such cells the separator is generally made of an inert substance, such as porcelain, sintered glass, cellulose, alumina, porous polytetrafluoroethylene or an ion exchange membrane.

The nature of the functional fluorinated derivatives obtained depends not only on the initial iodopolyfluoroalkane, but also on the operating conditions employed and especially on the water content of the solvent.

For example, if a perfluoroalkyl iodide $C_nF_{2n+l}I$ is used as the starting material and the reaction is carried out in the presence of sulfur dioxide, the reduction according to the invention mainly leads to perfluorocarboxylic acid: $C_{n-l}F_{2n-l}$—COOH if the formamide solvent contains less than 0.2% by volume of water; if the water content is greater than 0.2% by volume, a mixture of the perfluorocarboxylic acid $C_{n-l}F_{2n-l}$—COOH and the perfluorosulfinic acid $C_nF_{2n+l}$—$SO_2H$ is obtained, the proportion of the latter increasing rapidly up to approximately 95% when the water content reaches 20% by volume. Above this water content, the perfluorsulfinic acid $C_nF_{2n+l}$—$SO_2H$ is almost exclusively formed, but the overall chemical yield decreases rapidly. Consequently, if it is desired to prepare a perfluorocarboxylic acid, a formamide compound having as low a water content as possible should be used whereas, in order to obtain a perfluorosulfinic acid, the reaction is carried out in the presence of sulfur dioxide in a formamide compound assuming a water content greater than 5% by volume and, preferably, between 10 and 20%.

Similarly, the reduction of $\alpha$, $\omega$-diiodoperfluoralkanes, I—$(CF_2)_pI$, when carried out in the presence of sulfur dioxide in a formamide compound with a high water content (for example 10% by volume), leads to the formation of the disulfinic acid $HO_2S$—$(CF_2)_p$—$SO_2H$. In the absence of sulfur dioxide and with a water content of less than 0.2% by volume, the iodocarboxylic acid I—$(CF_2)_{p-l}$—COOH is obtained; additionally, if the reduction is continued after adding water and sulfur dioxide, this iodocarboxylic acid is then converted into the mixed diacid: $HO_2S$—$(CF_2)_{p-l}$—COOH. These iodocarboxylic acids and mixed carboxy-sulfinic diacids are new products and, as such, form part of the present invention.

If a 1-iodo-2-perfluoroalkylethane $C_nF_{2n+l}$—$CH_2CH_2I$ is used as the initial product and the reaction is carried out in the absence of sulfur dioxide and with a water content of less than 0.2% by volume, the reduction according to the invention leads to a mixture consisting of the corresponding alcohol $C_nF_{2n+l}CH_2$—$CH_2OH$ and the olefin $C_nF_{2n+l}CH$=$CH_2$, the proportion of alcohol increasing with decreasing current density applied and decreasing electrolyte content. The use of a formamide compound having a higher water content will lead to the concomitant formation of the corresponding perfluoroalkyl-ethane $C_nF_{2n+l}C_2H_5$.

EXAMPLES

The scope of the invention is further described in the following examples which set forth the preferred embodiments of the invention and which are not to be construed as limiting the scope of the invention in any manner.

EXAMPLE 1

A glass electrochemical cell divided, by means of a 30-mm-diameter sintered glass disc of porosity 3 or 4, into two compartments, anodic and cathodic, of 12- and 24-ml capacities, respectively, is used. The two electrodes were made of carbon fibres, each consisting of a 5-cm tuft containing 10,000 strands. 3 $\mu$m in diameter.

A mixture containing 22.5 ml of dimethylformamide, 2.5 ml of water, 0.1 g of lithium chloride. 5 $\mu$l of allyl alcohol and 4 g of sulfur dioxide was introduced into each compartment to a total volume of 11 ml in the anodic compartment and 16 ml in the cathodic compartment.

11.15 g (0.025 mole) of perfluorohexyl iodide was then introduced into the cathodic compartment, and an electric current of 50 mA corresponding to a P. D. of 12 volts was then applied between the two electrodes.

The reduction was carried out at constant current intensity. The contents of the cathode compartment (catholyte) was constantly stirred with a magnetic stirrer and a small current of gaseous sulfur dioxide is maintained in the anodic compartment throughout the period of electrolysis in order to avoid the diffusion of $C_6F_{13}I$.

After 14 hours of reaction (which corresponds to a Faraday yield of 95%). the catholyte was treated with 20 ml of a 10% aqueous solution of sulfuric acid, 10 ml of perfluorooctane was then added and the organic phase separated. After evaporating the perfluorooctane, 9 g of perfluorohexanesulfinic acid $C_6F_{13}SO_2H$ and 0.23 g of perfluorohexanoic acid $C_5F_{11}COOH$ were obtained, amounting to yields of 95% and 3% respectively.

The same result was obtained when the carbon fibres electrodes were replaced with vitreous carbon electrodes in the form of 30-mm-diameter discs, or when the lithium chloride was replaced with an equimolar quantity of zinc chloride or either tetrabutylammonium iodide or tetrabutylammonium perchlorate, or also when the quantity of lithium chloride was varied from 0.05 to 1 g.

The same result is also obtained operating at different current intensities, viz. 25 mA, 75 mA and 100 mA, with the period of electrolysis being 28 hours, 10.5 hours and 7 hours, respectively.

The following table gives the yields of perfluorohexanoic and perfluorohexanesulfinic acids obtained when the water content of the electrolytic medium is varied.

TABLE I

| Water content (% by volume) | Yield (%) of: $C_5F_{11}COOH$ | $C_6F_{13}SO_2H$ |
|---|---|---|
| Less than 0.2% (*) | 95 | — |
| 2% | 30 | 65 |
| 5 | 20 | 75 |
| 10 | 3 | 95 |
| 15 | 3 | 95 |
| 20 | 3 | 95 |
| 50 | — | 65 |
| 60 | — | 55 |

(*) Dimethylformamide dried over calcium hydride, and then subjected to a stream of gaseous nitrogen.

EXAMPLE 2

The reaction was carried out as in Example 1, but in the absence of sulfur dioxide and without adding water, using 25 ml of a dimethylformamide dried over $CaH_2$ (catholyte: 14 ml, anolyte: 11 ml). After 43 hours of electrolysis, perfluorohexanoic acid $C_5F_{11}COOH$ was obtained with a yield of 95%.

EXAMPLES 3 to 6

The reaction was carried out as in Example 1, but the allyl alcohol was replaced with the same volume of propargyl alcohol (Example 3), iodohydrin $C_6F_{13}CH_2$—CHI—$CH_2OH$ (Example 4) or 2-perfluorooctyL-1,1-dichloroethylene $C_8F_{17}$—CH=$CCl_2$ (Example 5). Example 6 utilized the same compound as Example 5, but the volume was increased to 2.5 ml.

The yields of perfluorohexanesulfinic and perfluoroalkanescarboxylic acids are given below:

| | Ex. 3 | Ex. 4 | Ex. 5 | Ex. 6 |
|---|---|---|---|---|
| $C_6F_{13}SO_2H$ | 78% | 72% | 25% | 75% |
| $C_5F_{11}COOH$ | 9% | 15% | 62% | 10% |

EXAMPLE 7

The reaction was carried out as in Example 1, but the dimethylformamide was replaced with the same volume of formamide or N-methylformamide.

With either material, the yields of perfluorohexanesulfinic and perfluorohexanoic acids are identical to those obtained in Example 1.

EXAMPLE 8

The reaction was carried out as in Example 1, but the dimethylformamide was replaced with 25 ml of formamide and only 0.5 ml of water were used.

The yields of perfluorohexanesulfinic and perfluorohexanoic acids were then 75 and 20% respectively.

EXAMPLE 9

The reaction was carried out as in Example 1, but the perfluorohexyl iodide was replaced with the same molar quantity of perfluorobutyl or perfluorooctyl iodide.

In the first case, perfluorobutanesulfinic acid $C_4F_9SO_2H$ and perfluorobutanoic acid $C_3F_7COOH$ were obtained, with yields of 95 and 3% respectively. In the second case, perfluorooctanesulfinic acid $C_8F_{17}SO_2H$ and perfluorooctanoic acid $C_7F_{15}COOH$ were obtained with the same yields.

When the 22.5 ml of dimethylformamide and the 2.5 ml of water were replaced with 25 ml of dimethylformamide dried over calcium hydride (water content less than 0.2% by volume), perfluorobutanoic acid alone was obtained in the first case and perfluorooctanoic acid alone is obtained in the second case, the yield being 95% in each case. This was also the case when the reaction was carried out in the absence of sulfur dioxide.

EXAMPLE 10

A glass electrochemical cell divided, by means of a 5 mm diameter sintered glass disc of porosity 3 or 4, into two compartments, one anodic and cathodic, of 3.5 and 7.5 ml capacities, respectively, was used. The two electrodes were made of carbon fibres, each consisting of a 1.5-cm tuft containing 10,000 strands, 3 μm in diameter.

A mixture containing 6.3 ml of dimethylformamide, 0.7 ml of water, 0.03 g of lithium chloride, 1.5 μL of allyl alcohol and 1 g of sulfur dioxide was introduced into each compartment to total volume of 3 ml in the anodic compartment and 4.5 ml in the cathodic compartment.

1.75 g of 1,4-diiodoperfluorobutane $I(CF_2)_4I$ were then introduced into the cathodic compartment, and an electric current of 5.5 mA corresponding to a potential difference of 4 V was then applied between the two electrodes.

The catholyte was stirred by means of a magnetic stirrer and a weak current of gaseous sulfur dioxide was maintained in the anodic compartment throughout the period of electrolysis.

After 40 hours of reaction (corresponding to a Faraday yield of 95%), the catholyte was treated as in Example 1. 1.2 g of perfluorobutane-1,4-disulphinic acid $HO_2S(CF_2)_4SO_2H$ are thereby obtained, amounting to a yield of 95%.

The $^{19}F$ NMR (reference: $CCl_3F$) and $^1H$ NMR (reference: tetramethylsilane) characteristics of this acid are as follows:

$\underline{CF_2}$—$CF_2$: δ=125.1 ppm
$\underline{CF_2}$—$SO_2H$: δ=132.5 ppm
$S\underline{O_2H}$: δ=9.8 ppm A similar result is obtained, but in a shorter time (9.hours), by applying an electric current of 25 mA.

EXAMPLE 11

The reaction is carried out as in Example 10, but in the absence of sulfur dioxide and without adding water, using 7 ml of a dimethylformamide dried over $CaH_2$ (water content≦0.2%).

After 36 hours of reaction and distillation under vacuum, the acid $I(CF_2)_3COOH$, with the following $^{19}F$ and $^1H$ NMR characteristics, was obtained, with a yield of 65%:

$\underline{CF_2}$—I: δ=66.6 ppm
$\underline{CF_2}$—COOH: δ=117.3 ppm
$\underline{CF_2}$—$\underline{CF_2}$—$CF_2$: δ=119.3 ppm
$\underline{COOH}$: δ=10 ppm

EXAMPLE 12

Example 11 was repeated, but after 36 hours of reaction, 0.05 g of sulfur dioxide and 0.7 ml of water were added to the electrolytic medium, and the reaction was then continued for a further period of 27 hours.

0.45 g of perfluorobutane-1,4-disulfinic acid and 0.6 g of the mixed diacid $HO_2S(CF_2)_3COOH$ are thereby obtained. Yields: 35% and 60% respectively.

The $^{19}F$ and $^1H$ NMR characteristics of the diacid $HO_2S(CF_2)_3$—COOH obtained were as follows:

$\underline{CF_2}$—COOH: δ=118.1 ppm
$\underline{CF_2}$—$\underline{CF_2}$—$CF_2$: δ=122.2 ppm
$\underline{CF_2}$—$S\underline{O_2H}$: δ=132.4 ppm
$S\underline{O_2H}$: δ=9.8 ppm
$CO\underline{OH}$: δ=9.6 ppm

EXAMPLE 13

The same cell and the same electrodes as in Example 1 are used and a mixture containing 25 ml of dimethylformamide previously dried over calcium hydride (water content less than 0.2% by volume), 0.1 g of lithium chloride and 5 μl of allyl alcohol were introduced into the cell, at a rate of 11 ml in the anodic compartment and 14 ml in the cathodic compartment.

5 g of 1-iodo-2-perfluorohexylethane $C_6F_{13}CH_2CH_2I$ are introduced into the latter, and an electric current of 12 mA corresponding to a P. D. of 4 V was then applied between the two electrodes, while maintaining the catholyte stirred by means of the follower of a magnetic stirrer, placed in the cathodic compartment.

After 69 hours of reaction, the catholyte was dissolved in 10 ml of perfluorooctane, allowed to settle, the fluorinated organic phase was separated, and 20 ml of water was added thereto. After evaporating the perfluorooctane and distilling under reduced pressure, 2.5 g of 2-perfluorohexylethanol $C_6F_{13}C_2H_4OH$ (B. P.20: 87° C.) and 1.1 g of perfluorohexylethylene $C_6F_{13}CH{=}CH_2$ (B. P. 760: 110° C.) were collected.

The same result was obtained if only 0.01 g of lithium chloride is used. Tables II and III below give the products and the yields obtained when Example 13 was repeated, varying the current intensity (Table II) or modifying the nature of the membrane dividing the cathodic and the anodic compartments (Table III).

TABLE II

| Operating conditions: | | Products obtained: | |
|---|---|---|---|
| I | P.D. | $C_6F_{13}C_2H_4OH$ | $C_6F_{13}CH{=}CH_2$ |
| 12 mA | 4 V | 68% | 32% |
| 20 mA | 5 V | 55% | 45% |

TABLE II-continued

| Operating conditions: | | Products obtained: | |
|---|---|---|---|
| I | P.D. | $C_6F_{13}C_2H_4OH$ | $C_6F_{13}CH{=}CH_2$ |
| 35 mA | 10 V | 50% | 50% |

TABLE III

| | Products obtained: | | |
|---|---|---|---|
| Membrane | $C_6F_{13}C_2H_4OH$ | $C_6F_{13}CH{=}CH_2$ | $C_6F_{13}C_2H_5$ |
| Sintered glass | 68% | 32% | — |
| Alumina | 60% | 40% | — |
| Cellulose | 85% | — | 15% |
| Porous Teflon (1 μ) | 85% | 15% | — |

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. Mixed diacids of the formula $$HO_2S{-}(CF_2)_{p-t}{-}COOH$$

wherein p is an even-numbered integer ranging from 4–12.

2. Mixed diacids of the formula $$HO_2S{-}(CF_2)_{p-t}{-}COOH$$

wherein p is equal to 4.

* * * * *

UNITED STATES PATENT AND TRADEMARK OFFICE

CERTIFICATE OF CORRECTION

PATENT NO. : 5,023,370

DATED : June 11, 1991

INVENTOR(S) : Sylvie Benfice-Malouet; Hubert Biancou

It is certified that error appears in the above-identified patent and that said Letters Patent is hereby corrected as shown below:

Column 1, line 68: change "$l$" to --1--.

Column 2, lines 1, 11 and 21: change "$l$" to --1--.

Column 3, line 14: change "$2n+l$" to --$2n+1$--.

Column 3, line 18: change "$2n-l$" to --$2n$-1--.

Column 3, line 22: change "$2n-l$" to --$2n$-1--.

Column 3, lines 23 and 27: change "$2n+l$" to --$2n+1$--.

Column 3, line 44: change "$p-l$" to --$p$-1--.

Column 3, line 47 - 48: change "$p-l$" to --$p$-1--.

Column 3, lines 51, 57, 58 and 63: change "$2n+l$" to --$2n+1$--.

UNITED STATES PATENT AND TRADEMARK OFFICE

CERTIFICATE OF CORRECTION

PATENT NO. : 5,023,370

DATED : June 11, 1991

INVENTOR(S) : Sylvie Benefice-Malouet; Hubert Blancou

It is certified that error appears in the above-identified patent and that said Letters Patent is hereby corrected as shown below:

Col. 8, claim 1, line 26, change "p-1" to --p- 1--;
claim 2, line 32, change "p-1" to --p- 1--.

Signed and Sealed this

Twentieth Day of October, 1992

*Attest:*

DOUGLAS B. COMER

*Attesting Officer*

*Acting Commissioner of Patents and Trademarks*